US008090466B2

(12) United States Patent
Yamada

(10) Patent No.: US 8,090,466 B2
(45) Date of Patent: Jan. 3, 2012

(54) EMBROIDERY DATA CREATION APPARATUS AND COMPUTER-READABLE MEDIUM ENCODING AN EMBROIDERY DATA CREATION PROGRAM

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1105 days.

(21) Appl. No.: 11/976,394

(22) Filed: Oct. 24, 2007

(65) Prior Publication Data

US 2008/0103624 A1 May 1, 2008

(30) Foreign Application Priority Data

Oct. 30, 2006 (JP) ..... 2006-294037

(51) Int. Cl.
*D05C 5/02* (2006.01)

(52) U.S. Cl. ..... 700/138; 112/470.04

(58) Field of Classification Search ..... 700/136–138; 112/470.01, 470.04, 475.18, 475.19
See application file for complete search history.

(56) References Cited

U.S. PATENT DOCUMENTS

| | | | | |
|---|---|---|---|---|
| 5,343,401 | A * | 8/1994 | Goldberg et al. | 700/138 |
| 5,474,000 | A * | 12/1995 | Mizuno et al. | 112/475.19 |
| 5,740,057 | A * | 4/1998 | Futamura | 700/138 |
| 5,794,553 | A * | 8/1998 | Futamura | 700/138 |
| 5,954,004 | A * | 9/1999 | Futamura | 700/138 |
| 6,304,793 | B1 * | 10/2001 | Komiya et al. | 700/138 |
| 6,502,006 | B1 * | 12/2002 | Laufer et al. | 700/138 |
| 6,629,015 | B2 | 9/2003 | Yamada | |
| RE38,718 | E * | 3/2005 | Futamura | 700/138 |
| 2005/0283268 | A1 * | 12/2005 | Hagino et al. | 700/138 |

FOREIGN PATENT DOCUMENTS

| | | |
|---|---|---|
| JP | A 10-314471 | 12/1998 |
| JP | A 2001-259268 | 9/2001 |
| JP | A 2002-078992 | 3/2002 |
| JP | A 2003-154181 | 5/2003 |
| JP | A 2003-326012 | 11/2003 |

* cited by examiner

*Primary Examiner* — Nathan Durham
(74) *Attorney, Agent, or Firm* — Oliff & Berridge, PLC

(57) ABSTRACT

An embroidery data creation apparatus includes a thread color relation value storage device that stores a color relation value that corresponds to a color, for each embroidery thread which is used in an embroidery data, a preview image creation device that creates a preview image, a preview display device that displays the preview image created, a reference region specification device that specifies as a color modification reference region at least one region in the preview image, a thread color selection device that selects a thread color to be used for the reference region specified, an image data color modification device that modifies the color of the image data based on the color relation value corresponding to a color of a reference image region and the color relation values corresponding to the thread color selected, and an embroidery data creation device that creates the embroidery data from color-modified image data obtained.

18 Claims, 13 Drawing Sheets

FIG. 9

590

| | | |
|---|---|---|
| 100 | 50 | 50 |
| 200 | 100 | 50 |
| 200 | 200 | 100 |

EMBROIDERY DATA CREATION APPARATUS AND COMPUTER-READABLE MEDIUM ENCODING AN EMBROIDERY DATA CREATION PROGRAM

CROSS-REFERENCE TO RELATED APPLICATION

This application claims priority from JP2006-294037, filed on Oct. 30, 2006, the disclosure of which is hereby incorporated by reference in its entirety.

BACKGROUND

The present disclosure relates to an embroidery data creation apparatus and a computer-readable recording medium encoding an embroidery data creation program.

Conventionally, photograph embroidery has been performed to embroider an image of a photograph taken with a digital camera or a photograph printed from a film. The photograph embroidery uses image data of a photograph taken with a digital camera or image data obtained by scanning with a scanner, a photograph printed from a film. An embroidery data creation apparatus has been proposed that creates, based on image data, embroidery data required to embroider with threads of a plurality of colors. For example, an embroidery data creation apparatus described in Japanese Patent Application Laid Open Publication No. 2001-259268 creates, from an image data, line segment data which indicates a shape of a stitch of a thread and color data which indicates a color of a stitch, thereby creating embroidery data, which indicates a stitch, for each of the thread colors.

SUMMARY

However, there are some instances where creating embroidery data from an image data produces undesirable results such as the embroidery data being too dark, too bright, or indistinct in color shade. To solve such problems, coping approaches may be considered, for example, adjustment of hue, chroma saturation, brightness, and contrast of the image data by using an image editing software or the like. However, if the embroidery data is totally dark in color shade, for example, even if the brightness of the image data is increased to modify the image to be brighter, thereby making the embroidery data brighter, this could produce the undesired effect that a thread having a lighter color will be used. Thus, the desired result cannot always be obtained by the coping approaches described earlier. In an alternative approach, a desired embroidery result can be obtained by processing a variety of the image data attributes in addition to brightness, such as hue, chroma saturation, and contrast. However, this approach is problematic because technical knowledge and special skills will be required to create embroidery data based on image data and processing of images.

In one aspect of the present disclosure, an embroidery data creation apparatus and an embroidery data creation program by which a desired embroidery result can be obtained without any technical knowledge or special skills of creation of embroidery data and image processing needed and a computer-readable medium encoding an embroidery data creation program are provided.

A first aspect of the present disclosure provides an embroidery data creation apparatus including a thread color relation value storage device that stores a color relation value that corresponds to a color, for each embroidery thread which is used in an embroidery data, wherein the embroidery data is created based on image data already formed with an aggregate of pixels, a preview image creation device that creates a preview image required to confirm a result of an embroidery performed using the embroidery data created based on the image data, a preview display device that displays the preview image created by the preview image creation device, a reference region specification device that specifies as a color modification reference region at least one region in the preview image being displayed on the preview display device, a thread color selection device that selects a thread color to be used for the reference region specified by the reference region specification device from among the thread colors whose color relation values are stored in the thread color relation value storage device, an image data color modification device that modifies the color of the image data by changing the color relation value of the pixels in the image data based on the color relation value corresponding to a color of a reference image region which is a region in the image data corresponding to the reference region and the color relation values stored in the thread color relation value storage device corresponding to the thread color selected by the thread color selection device and an embroidery data creation device that creates the embroidery data from color-modified image data obtained after modifying the color by using the image data color modification device.

A second aspect of the present disclosure provides an embroidery data creation apparatus including a storage device that stores a color relation value that corresponds to a color, for each embroidery thread that is used in embroidery data, wherein the embroidery data is created based on image data already formed with an aggregate of pixels; a display device; and a controller that creates a preview image required to confirm a result of an embroidery performed using the embroidery data created based on the image data, wherein the preview image is displayed by the display device, specifies as a color modification reference region at least one region in the preview image being displayed by the display device, selects a thread color to be used for the reference region specified from among the thread colors whose color relation values are stored in the storage device, modifies a color of the image data by changing a color relation value of pixels in the image data based on a color relation value associated with a color of a reference image region which is a region in the image data corresponding to the reference region and color relation values stored in the storage device corresponding to the thread color to be used for the reference region, and creates the embroidery data from color-modified image data obtained after modifying the color of the image data.

A third aspect of the present disclosure provides a computer-readable medium encoding an embroidery data creation program, the embroidery data creation program comprising instructions for storing a color relation value that corresponds to a color, for each embroidery thread which is used in an embroidery data, wherein the embroidery data created based on image data already formed with an aggregate of pixels, creating a preview image for confirming a result of an embroidery performed using the embroidery data that is based on the image data, displaying the preview image, specifying, as a color modification reference region, at least one region in the preview image being displayed, selecting a thread color to be used for the reference region specified from among the thread colors whose color relation values are stored, modifying the color of the image data by changing a color relation value of the pixels in the image data based on the color relation value that corresponds to a color of a reference image region that is a region in the image data corresponding to the reference region and the stored color relation values corresponding to the selected thread color, and creating the embroidery data from color-modified image data obtained after modifying the color.

BRIEF DESCRIPTION OF THE DRAWINGS

Various aspects of the present disclosure will be described with references to the following drawings.

FIG. 9 is a schematic diagram of luminance values of a target pixel and the surrounding pixels;

DETAILED DESCRIPTION OF EMBODIMENTS

An embodiment of an embroidery data creation apparatus 1 according to the present disclosure will be described through reference to drawings. The embroidery data creation apparatus 1 of the present embodiment creates, based on image data, embroidery data required to output a design represented by the image data in a form of embroidery by use by an embroidery sewing machine 3. First, the embroidery sewing machine 3 will be described below.

Figure 1:
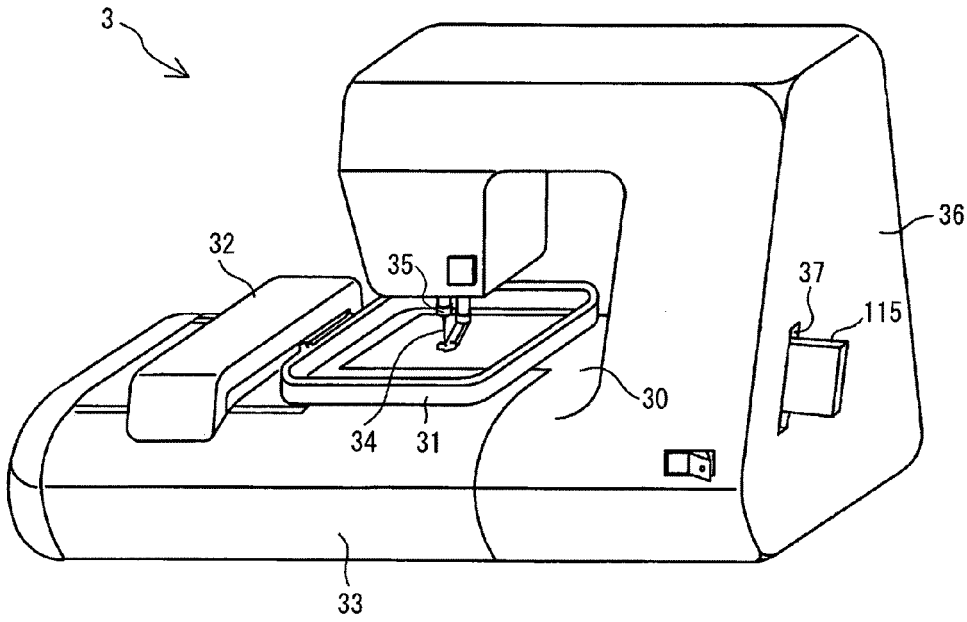
FIG. 1 is an external view of an embroidery sewing machine.

As shown in FIG. 1, the embroidery sewing machine 3 comprises a needle bar mechanism (not shown) that vertically drives a needle bar 35 to which a sewing needle 34 is mounted, a thread take-up mechanism (not shown), and a shuttle mechanism (not shown). The embroidery sewing machine 3 further comprises an embroidery frame 31 and a Y-directional drive mechanism (not shown) and an X-directional drive mechanism (not shown) that shift the embroidery frame 31. The embroidery frame 31 is disposed on a sewing machine bed 30, to hold a work cloth (not shown) to be embroidered. The Y-directional drive mechanism, which is housed in a carriage cover 32, shifts the embroidery frame 31 in a vertical direction of the embroidery sewing machine 3 (back and forth direction of the paper). The X-directional drive mechanism, which is housed in a body case 33, shifts the embroidery frame 31 in a horizontal direction of the embroidery sewing machine 3 (right-and-left direction of the paper).

The work cloth is embroidered with a predetermined design by sewing through cooperation of the needle bar mechanism, the thread take-up mechanism, and the shuttle mechanism as the embroidery frame 31 is moved by the Y-directional and X-directional drive mechanisms. A sewing machine motor (not shown), which drives the needle bar mechanism, the thread take-up mechanism, and the shuttle mechanism, and motors (not shown) which drive the Y-directional and X-directional drive mechanisms, respectively, are controlled by a control device. The control device may be a microcomputer or the like built in the embroidery sewing machine 3.

Further, the embroidery sewing machine 3 has a memory card slot 37 formed on a side surface of a pillar 36. By inserting a memory card 115, which stores embroidery data, into the memory card slot 37, embroidery data created in the embroidery data creation apparatus 1 is supplied to the embroidery sewing machine 3. Alternatively, the embroidery sewing machine 3 and the embroidery data creation apparatus 1 may be arranged so that they can be connected to each other through a cable, allowing the embroidery data to be directly supplied to the embroidery sewing machine 3 without the need for a recording medium such as a memory card.

Figure 3:
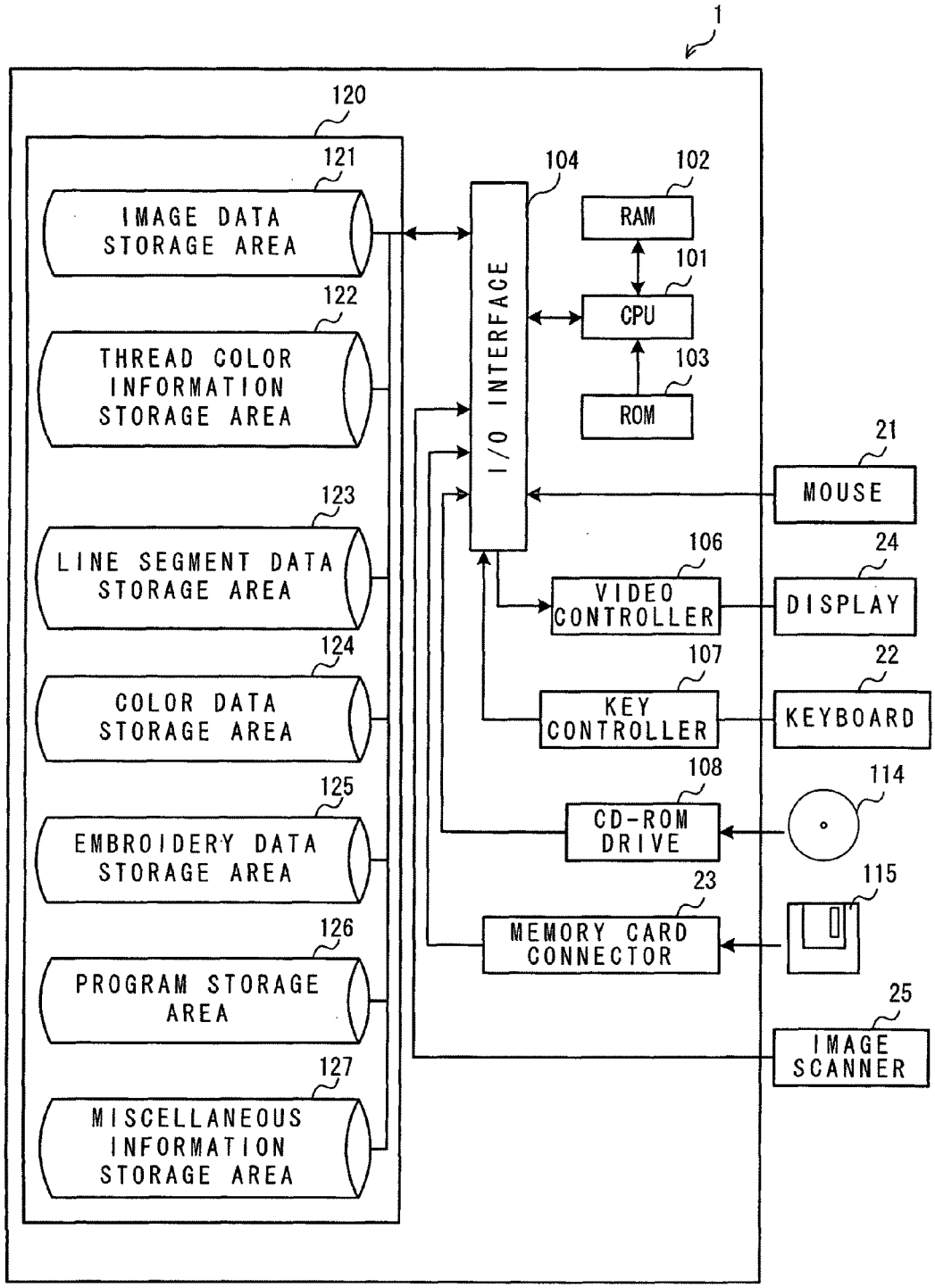
FIG. 3 is a block diagram of an electrical configuration of the embroidery data creation apparatus.
Figure 4:
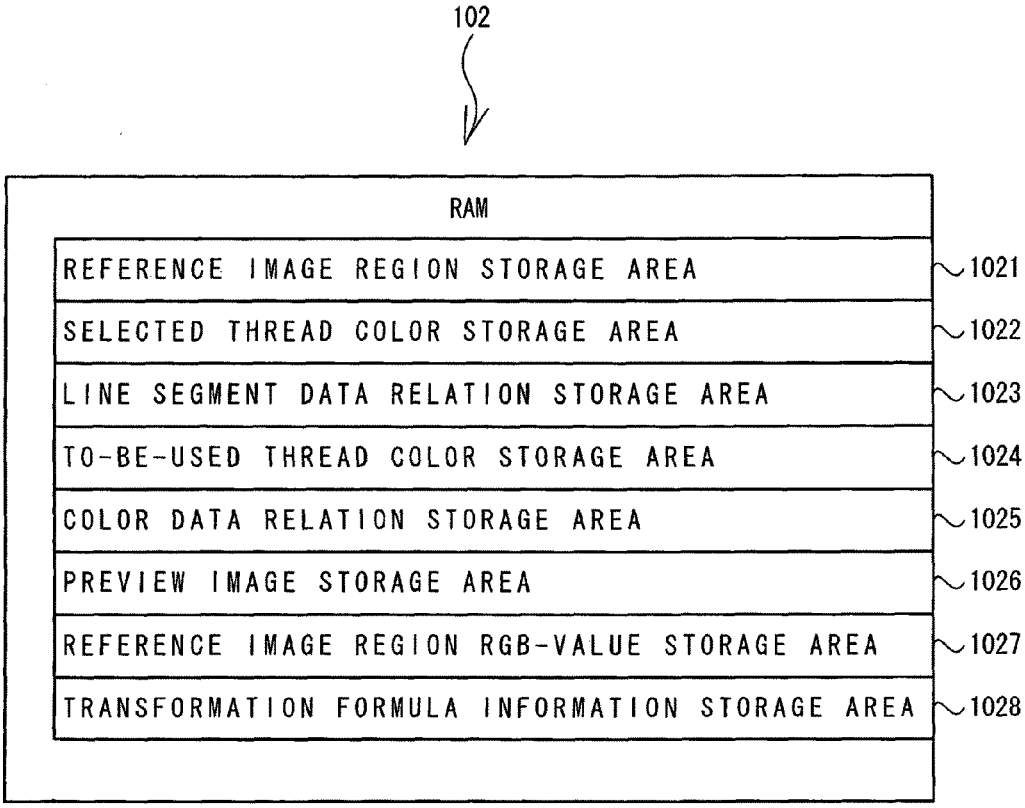
FIG. 4 is a conceptual diagram of a RAM.

Next, the embroidery data creation apparatus 1 will be described below through reference to FIGS. 2-4.

Figure 2:
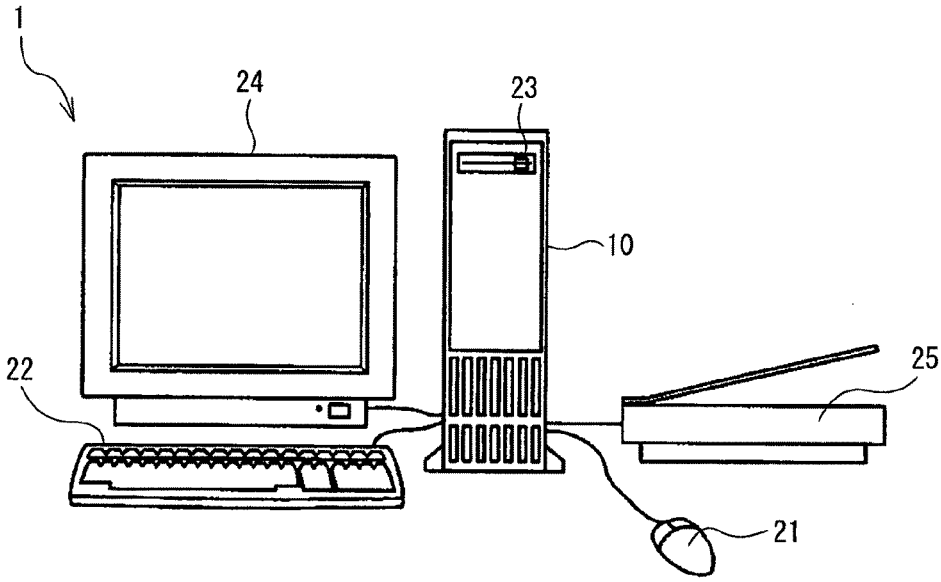
FIG. 2 is a diagram of an embroidery data creation apparatus.

As shown in FIG. 2, the embroidery data creation apparatus 1 comprises an apparatus body 10, which in this embodiment is a personal computer. A mouse 21, a keyboard 22, a memory card connector 23, a display 24, and an image scanner 25 are connected to the apparatus body 10. It is to be noted that shapes of the apparatus body 10, the mouse 21, the keyboard 22, the memory card connector 23, the display 24, and the image scanner 25 are not limited to those shown in FIG. 2. For example, the apparatus body 10 need not be a tower type but may be a transverse-mounted type. Further, the apparatus body 10 may be of a notebook type, in which the display 24 and the keyboard 22 are integrated with the apparatus body 10. Also, the apparatus body 10 may be a dedicated computer rather than a personal computer. Further, the image scanner 25 need not be connected to the embroidery data creation apparatus 1.

Next, an electrical configuration of the embroidery data creation apparatus 1 will be described below through reference to FIG. 3. As shown in FIG. 3, the embroidery data creation apparatus 1 is equipped with a CPU 101 serving as a controller that controls the embroidery data creation apparatus 1. A RAM 102 in which temporarily stores a variety of kinds of data, a ROM 103 that stores the BIOS etc., and an I/O interface 104 that mediates delivery and receipt of data are connected to the CPU 101. A hard disk drive 120 is connected to the I/O interface 104. The hard disk drive 120 has at least an image data storage area 121, a thread color information storage area 122, a line segment data storage area 123, a color data storage area 124, an embroidery data storage area 125, a program storage area 126, and a miscellaneous information storage area 127.

It is to be noted that in the image data storage area 121, image data that serves as a source from which embroidery data is created is stored. The image data may be such data that is input through the image scanner 25 or any other image scanner connected to any other apparatus. Alternatively, the image data may be stored in the memory card 115 after image photographing by use of a digital camera. Further, the image data may be those acquired by any other apparatus through a network since the embroidery data creation apparatus 1 is equipped with communication means for connecting to a network.

Information related to the colors of threads that can be used in the embroidery sewing machine 3 is stored in the thread color information storage area 122. Line segment data including information of line segments which indicate a shape of embroidery stitches is stored in the line segment storage area 123, and color data including information of colors corresponding to the line segment data is stored in the color data storage area. In the embroidery data storage area 125, embroidery data, which is created by an embroidery data creation program, is stored. The embroidery data is read to the embroidery sewing machine 3. In the program storage area 126, the embroidery data creation program is stored and is executed by the CPU 101. In the miscellaneous information storage area 127, other information to be used by the embroidery data creation apparatus 1 is stored. It is to be noted that if the embroidery data creation apparatus 1 is a dedicated one not equipped with the hard disk drive 120, the program is stored in the ROM.

Further, to the I/O interface 104 are connected the mouse 21, a video controller 106, a key controller 107, a CD-ROM drive 108, the memory card connector 23, and the image scanner 25. To the video controller 106, the display 24 is connected, and to the key controller 107, the keyboard 22 is connected. A CD-ROM 114 that is inserted into the CD-ROM drive 108 stores the embroidery data creation program, which is a control program for the embroidery data creation apparatus 1. When the CD-ROM 114 is inserted into the CD-ROM drive 108, the control program is set up from the CD-ROM 114 to the hard disk drive 120 and stored in the program storage area 126. Further, the memory card connector 23 enables reading data from and writing it to the memory card 115.

Next, related storage areas provided in the RAM 102 according to the present disclosure will be described below with reference to FIG. 4. As shown in FIG. 4, the RAM 102 includes a reference image region storage area 1021, a selected thread color storage area 1022, a line segment data relation storage area 1023, a to-be-used thread color storage area 1024, a color data relation storage area 1025, a preview image storage area 1026, a reference image region RGB-value storage area 1027, and a transformation formula information storage area 1028. It is to be noted that the RAM 102 may include other various storage areas.

The reference image region storage area 1021 stores values indicating pixels of a reference image region for image data that corresponds to a region specified as a reference region for which a thread color is selected on a reference region specification screen 200 which will be described later in this disclosure with reference to FIG. 6. The pixels of image data stored in the image data storage area 121 are represented in a coordinate system. For example, the coordinates of the pixels placed at the upper left corner and lower right corner in a reference image region are stored. In the selected thread color storage area 1022 is stored a value that indicates a thread color selected on a thread color section screen 300, which is described later in the present disclosure with reference to FIG. 7. In the line segment data relation storage area 1023 are stored the values of angle characteristics, their strength, and the like which have been calculated when creating line segment data. In the to-be-used thread color storage area 1024 are stored values that indicate n number of thread colors to be used in embroidery. In the present embodiment, n=10 is assumed. The color data relation storage area 1025 is used when creating color data. In the preview image storage area 1026 is stored a preview image, and in the reference image region RGB-value storage area 1027 are stored an R-value, a G-value, and a B-value that indicate in which color the region of image data specified as a reference image region appears to a user as a whole.

Next, a screen that is displayed by the display 24 when a thread color and a region in relation to a preview image is specified will be described with reference to FIGS. 5-7.

Figure 5:
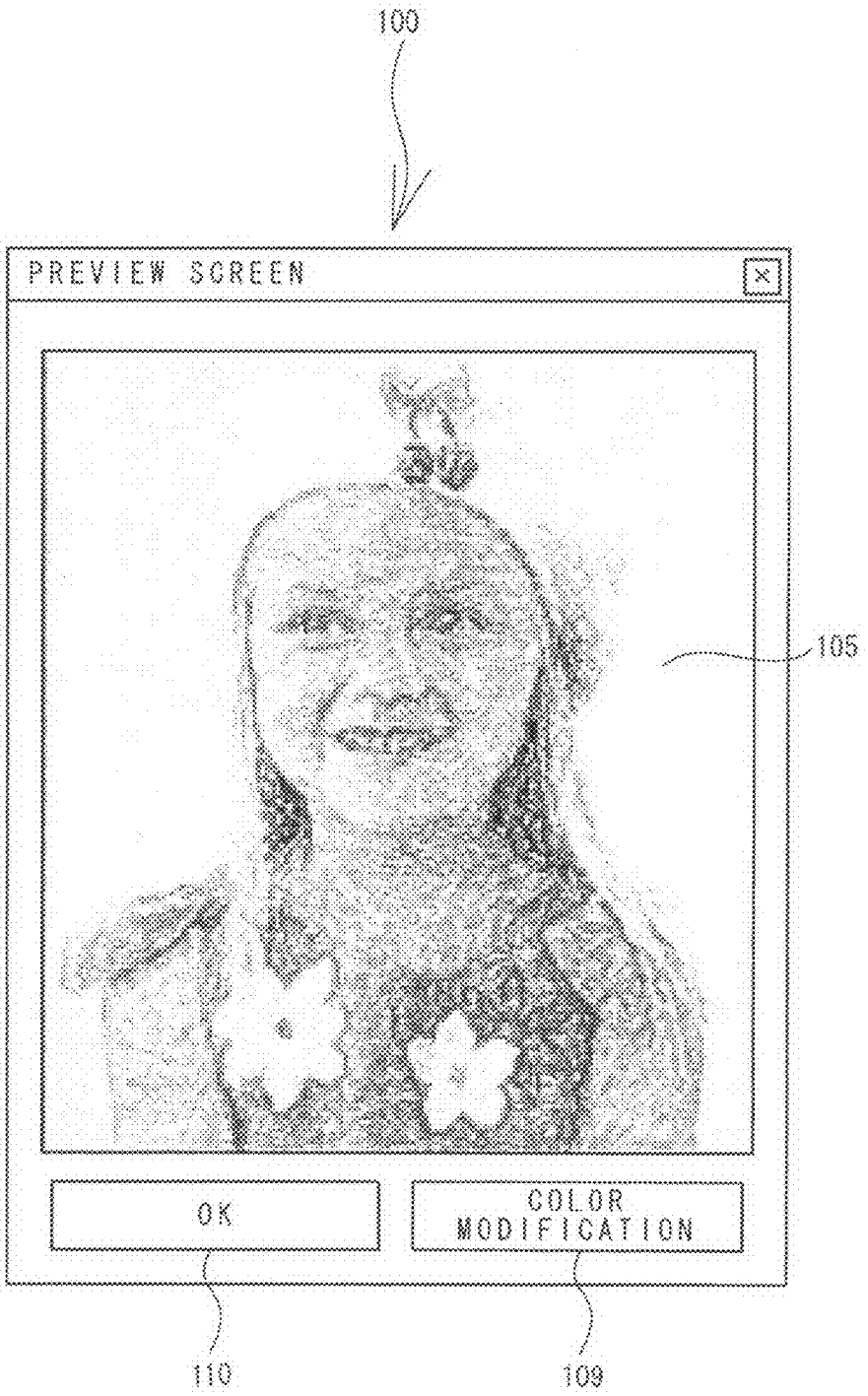
FIG. 5 is an example of a preview screen.

As shown in FIG. 5, on the preview screen 100 are provided a preview image region 105 to display a preview image therein, an OK button 110, and a color modification button 109. The preview image region 105 displays therein a preview image indicating a result of embroidery when embroidery data is created based on image data stored in the image data storage area 121. If the OK button 110 is then selected, the embroidery data is created on the basis of the image data from which the preview image being displayed in the preview image region 105 was created. Further, if the color modification button 109 is selected, the reference region specification screen 200 shown in FIG. 6 appears.

Figure 6:
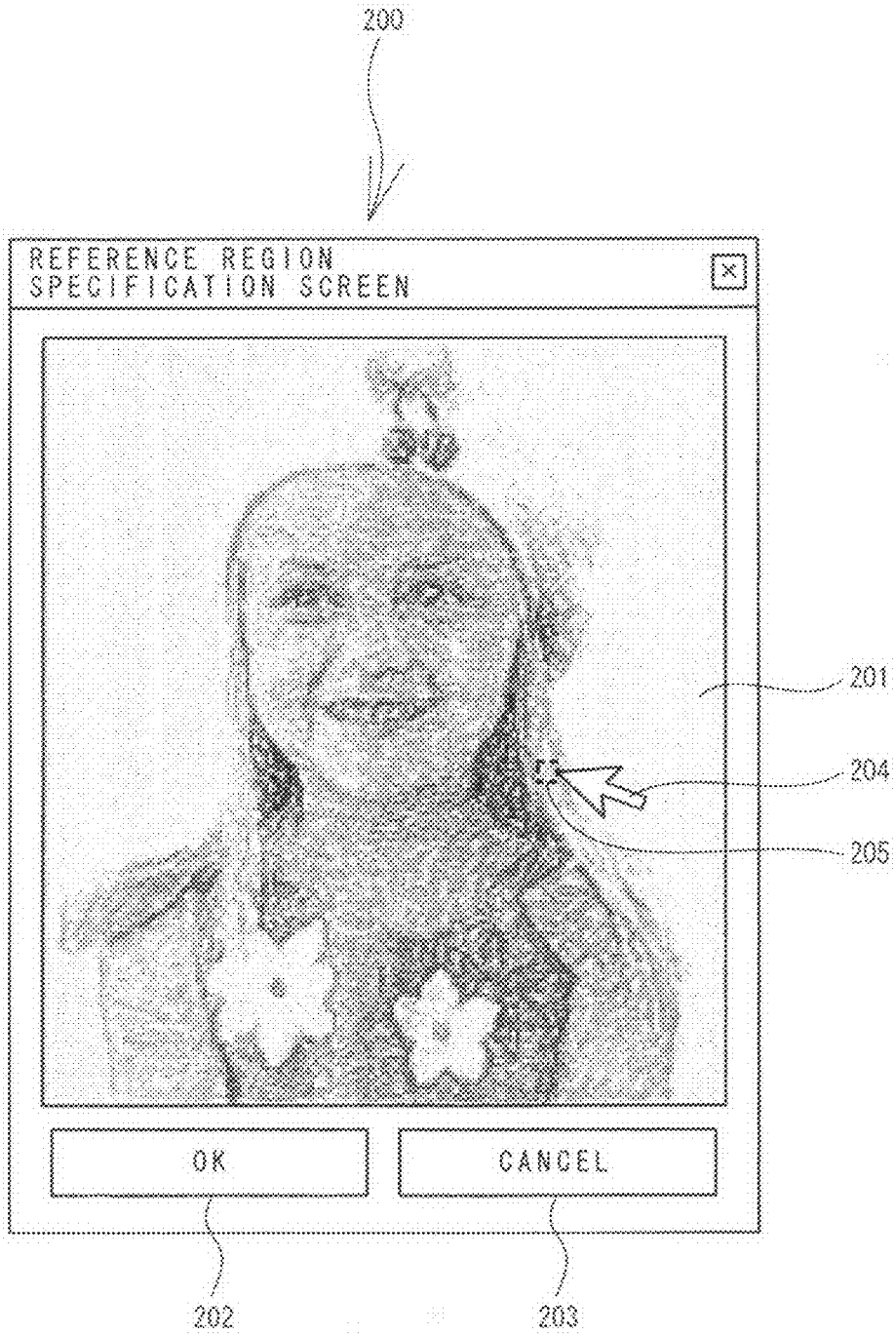
FIG. 6 is an example of a reference region specification screen.

As shown in FIG. 6, on the reference region specification screen 200 are provided a preview image region 201, an OK button 202, and a cancel button 203. If a mouse pointer 204 exists in the preview image region 201, a region specification frame 205 appears to enclose a predetermined region at the tip of the mouse pointer 204. If the mouse is clicked at the mouse pointer 204 placed in the preview image region 201, a value indicating a reference image region for the image data corresponding to the region enclosed by the region specification frame 205 is stored as a reference region in the reference image region storage area 1021. It is to be noted that the size of the region specification frame 205 is determined on the basis of the size of image data. For example, if the image data has a size of 300 dots by 300 dots, a region having 10 dots by 10 dots is enclosed by the region specification frame 205. If the OK button 202 is then selected, the thread color specification screen 300 shown in FIG. 7 appears, allowing the color of a thread to be used at a portion specified with the region specification frame 205 to be selected. On the other hand, if the cancel button 203 is selected, the preview screen 100 is recovered.

Figure 7:
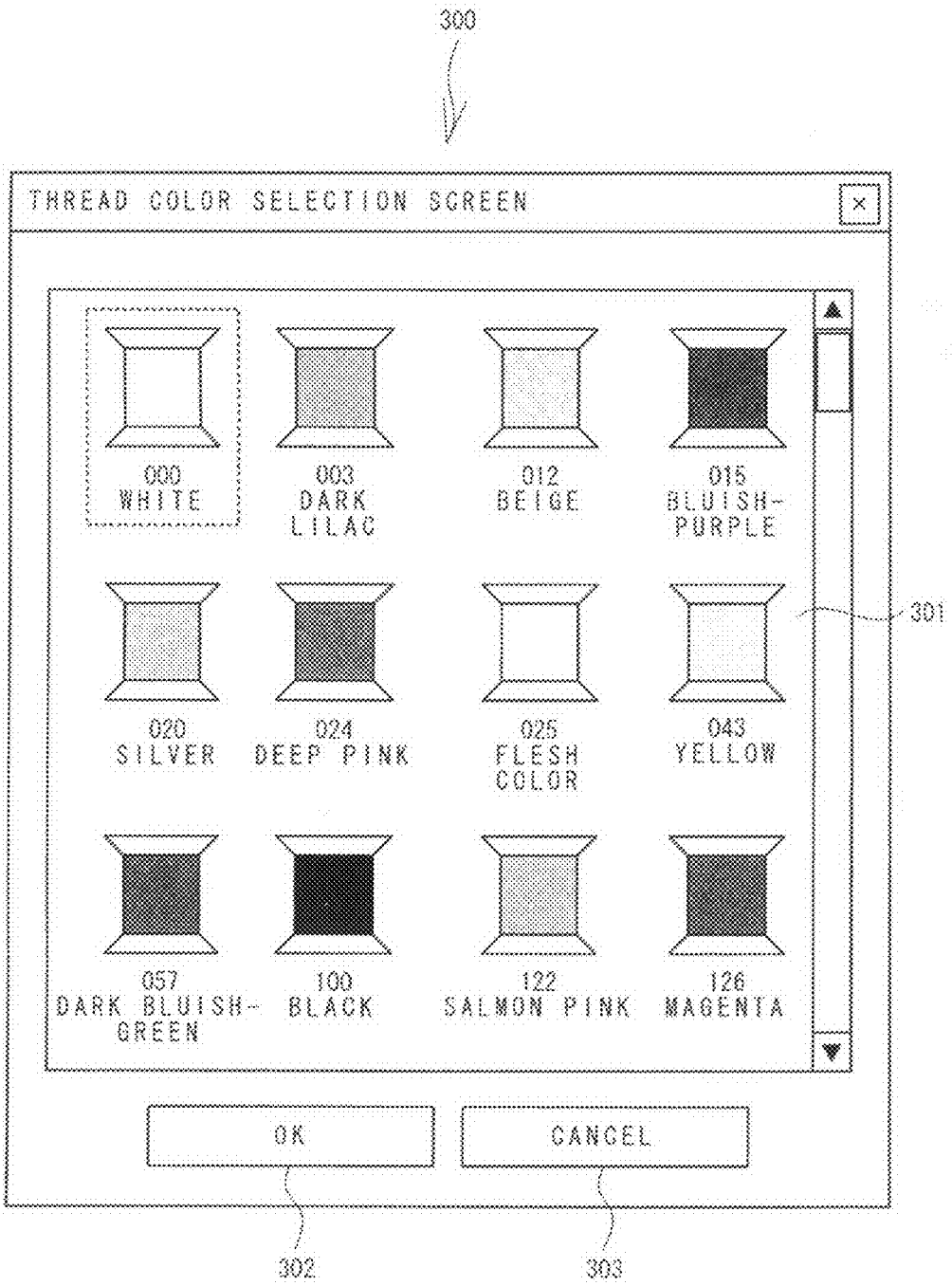
FIG. 7 is an example of a thread color selection screen.

As shown in FIG. 7, on the thread color selection screen 300 are provided a thread color selection region 301, an OK button 302, and a cancel button 303. In the thread color selection region 301 are displayed illustrations that indicate the various thread colors usable in the embroidery sewing machine 3 and their part numbers and color names. The illustrations indicating the thread colors each show a bobbin on which a thread is wound, a middle portion of the bobbin having a corresponding thread color, thereby assisting a user in determining the a color to use. In an example shown in FIG. 7, white indicated by a part number "000" is selected. If the OK button 302 is then selected, a thread color currently selected in the thread color selection region 301 is stored in the selected thread color storage area 1022. On the other hand, if the cancel button is selected, the reference region specification screen 200 is recovered.

Next, the operations of the embroidery data creation program will be described below with reference to a flowchart shown in FIG. 8. The processing of the flowchart shown in FIG. 8 starts when the embroidery data creation program is executed. First, the user specifies an image data, which provides a source from which embroidery data is to be created (S1). Specifically, an image data specification screen (not shown) appears, on which then the user specifies the image data. Then, the specified image data is stored in the image data storage area 121.

Based on this image data stored in the image data storage area 121, line segment data is created and stored in the line segment data storage area 123 (S2). The creation of line segment data will be described in detail below. Line segment data is created on the basis of an angle characteristic and an intensity of the angle characteristic obtained for each of the pixels contained in image data. An angle characteristic of a pixel indicates in which direction (at what angle) the color of this pixel continues when this color is compared to those of the surrounding pixels, while an intensity of the angle characteristic indicates a level of continuity. Thus, an angle characteristic of a pixel does not represent the continuity of the pixel's color only in relation to neighboring pixels but represents the continuity of the color in a larger region. That is, an angle characteristic is a numeric version of a direction in which a human being, who is looking at an image far away from him, perceives continuity of the color of the image. The inclination of a line segment corresponds to an angle represented by the angle characteristic of a pixel. Further, an intensity of the angle characteristic of a pixel is compared to the intensities of angle characteristics of surrounding pixels when determining whether to perform embroidery indicated by the line segment of the pixel or not to perform embroidery by deleting the line segment.

First, the image data is transformed into a gray scale and undergoes transformation processing by means of a known high-pass filter. Based on a converted image obtained through the transformation processing, an angle characteristic and its intensity are calculated for each of the pixels of the image. Next, the manner in which an angle characteristic and its intensity are calculated will be described. First, the angle characteristic of a target pixel having a luminance value is calculated with reference to the luminance values of a surrounding N number of dots of pixels. A luminance value is a numeric representation of color and is a numeral in the range of 0 to 255. For, example, luminance value "0" represents "black" and luminance value "255" represents "white". For the purpose of simplifying the following description, N=1 will be assumed, where N indicates a distance of a surrounding reference pixel with respect to the target pixel. Therefore, if N=1, only pixels neighboring the target pixel will be referenced. If N=2, pixels neighboring the target pixel and also pixels surrounding the neighboring pixels will be referenced.

First, the process calculates the absolute value of a difference in luminance value between the target pixel and each of the right pixel, the lower right pixel, the lower pixel, and the lower left pixel for each pixel data. Based on those calculated results, the process obtains a "normal line-directional angle of angle characteristic" that corresponds to a direction of higher discontinuity of the pixel values in the region. Then, the process adds 90 degrees to the "normal line-directional angle of angle characteristic" to provide an "angle characteristic".

Specifically, first, based on the calculated results in the respective directions, the process obtains sums Tb, Tc, Td, and Te of the respective calculation results. Tb, Tc, Td and Te respectively represent the sum of the right-directional calculation results, the sum of the lower right-directional calculation results, the sum of the lower calculation results, and the sum of the lower left-directional calculation results. From sums Tb, Tc, Td, and Te, the process calculates the sums of horizontal components and vertical components respectively, to calculate an arctangent value. In this case, it is considered that the horizontal and vertical components in the lower right direction and those in the lower left direction will offset each other.

If the lower right-directional (45-degree directional) sum Tc is larger than the lower left-directional (135-degree directional) sum Te (Tc>Te), the horizontal component sum and the vertical component sum are considered to be Tb+Tc−Te and Td+Tc−Te, respectively on the assumption that the lower right direction is positive (+) and the lower left direction is negative (−) for the horizontal and vertical components in order for a resultant desired to be between 0 to 90 degrees.

Conversely, if the lower right-directional sum Tc is smaller than the lower left-directional sum Te (Tc<Te), the horizontal component sum and the vertical component sum are considered to be Tb−Tc+Te and Td−Tc+Te, respectively on the assumption that the lower left direction is positive (+) and the lower right direction is negative (−) for the horizontal and vertical components in order for a resultant desired value to be between 90 and 180 degrees. In this case, since the resultant desired value should be between 90 and 180 degrees, the vertical component sum is multiplied by "−1" before calculating the arctangent value.

Consider, for example, the pixel arrangement shown in FIG. 9. As shown in FIG. 9, the target pixel has a luminance value of "100", while the surrounding pixels sequentially have luminance values of "100", "50", "50", "50", "100", "200", "200", and "200" moving in a clockwise direction beginning at the upper left pixel. Because each of the right column pixels (having luminance values of "50", "50", and "100" moving in a downward direction starting at the upper right pixel) does not have a corresponding right-directional pixel, the difference in luminance value between each of the right column pixels and the corresponding right-directional pixel is "0". Further, since the top pixel in the center column has luminance value "50" and its right pixel has luminance value "50", the difference is "0"; since the center pixel in the center column, (i.e., the target pixel) has luminance value "100" and its right pixel has luminance value "50", the absolute value of the difference is "50"; since the bottom pixel in the center column has luminance value "200" and its right pixel has luminance value "100", the absolute value of the difference is "100"; since the top pixel in the left column has luminance value "100" and its right pixel has luminance value "50", the absolute value of the difference is "50; since the center pixel in the left column has luminance value "200" and its right pixel has luminance value "100", the absolute value of the difference is "100"; and since the bottom pixel in the left column has luminance value "200" and its right pixel has luminance value "200", the absolute value of the difference is "0".

Therefore, Tb=0+0+0+0+50+100+50+100+0=300. Similarly, Tc=0, Td=300, and Te=450. Since Tc<Te, the desired resultant value becomes 90 to 180 degrees. The sum of the horizontal components is Tb−Tc+Te=300−0+450=750 and the sum of the vertical components is 300−0+450=750, so that they are all multiplied by "−1" before calculation of arctangent, resulting in arctan(−750/750)=−45 degrees. This angle represents a "normal line-directional angle of angle characteristic."

This angle obtained as a result of calculation is supposed to indicate a direction in which discontinuity of the pixels in a target region becomes higher. Therefore, in this case, the target pixel has an angle characteristic of −45+90=45 degrees. Here, the lower right direction is defined as positive in the horizontal and vertical components, so that the obtained value of 45 degrees represents the lower right direction. In the above example, the angle characteristic may be said to be obtained from a difference with respect to color information of the pixels surrounding the target pixel. Although this example has used brightness (luminance value) of each of the pixels as the color information, similar results can be obtained if chroma saturation or color shade is used as the color information.

The intensity of the angle characteristic obtained is calculated using Equation (1) given below. In the previous example, the total sum of the differences is the sum of sums Tb, Tc, Td, and Te, so that the intensity is (300+0+300+450)×(255−100)÷255÷16=39.9. It is to be noted that the angle characteristic represents a direction in which brightness changes and the intensity of the angle characteristic represents a magnitude of the change in brightness.

$$\text{Angle Characteristic Intensity} = \text{Sum of Differences} \times \frac{(255 - \text{Value of Target Pixel})}{255 \times (N \times 4)^2} \quad (1)$$

It is to be noted that in the present embodiment, it is possible to apply a known Prewitt operator or Sobel operator to gray scale version of image data, thereby obtaining an angle characteristic and its intensity for each of the pixels of an image. For example, in the case of using a Sobel operator, supposing sx and sy to be a result of applying a horizontal operator and a result of applying a vertical operator in coordinates (x, y), respectively, an angle characteristic and its intensity at the coordinates (x, y) can be calculated by Equation (2).

$$\text{Angle characteristic} = \tan^{-1}(sy/sx)$$

$$\text{Angle characteristic intensity} = \sqrt{sx \cdot sx + sy \cdot sy} \quad (2)$$

In such a manner, an angle characteristic and its intensity are calculated for each of the pixels of image data. Those calculation results are stored in the line segment data relation storage area 1023 in the RAM 102. Then, line segment information having an angle component and a length component is created for each pixel. As the angle component, an angle characteristic is used which is stored in the line segment relation storage area 1023 beforehand. As the length component, a preset fixed value or a value entered by the user is used.

It is to be noted that if embroidery data is created using the line segment data made up of the line segment information created for all of the pixels, the line segment information is uniformly created for all pixels, including pixels having smaller angle characteristic intensities. Thus, if embroidery is performed in accordance with embroidery data created on the basis of this line segment data, too many needles may be used or the same portion may be sewn several times, thereby deteriorating a sewing quality. To solve this problem, the pixels of the image data are sequentially scanned from right to left and top to down, and the line segment information of only those pixels having an angle characteristic intensity larger than a predetermined threshold value is considered to be valid. It is to be noted that the "angle characteristic intensity threshold", may be a preset fixed value or a value entered by a user.

Next, the line segment information of those pixels that have an angle characteristic intensity smaller than the predetermined threshold value and that do not overlap with a line segment identified with the already created line segment information is validated. First, the pixels surrounding the target pixel (which has an angle characteristic intensity smaller than the predetermined threshold value and does not overlap with an already identified line segment) are scanned, as a result of which for those pixels having a larger angle characteristic intensity than the above-described threshold value, the process respectively obtains the sum T1 of the products of the cosine values of the angle characteristics and the angle characteristic intensities and the sum T2 of the products of the sine values of the angle characteristics and the angle characteristic intensities. Then, the process determines an angle component by using the arctangent value of T2/T1 as a new angle characteristic, to create a line segment information having the above-described length component. It is difficult to reflect accurately in the line segment data, the angle characteristics of those pixels having smaller angle characteristic intensities. Therefore, as described above, the line segment information is created on the basis of new angle characteristics calculated by taking into account the angle characteristics of the surrounding pixels. In such a manner, embroidery data is created which is capable of reproducing an image with increased quality. The aggregate of the thus created line segment information provides a line segment data, which is stored in the line segment data storage area 123.

Figure 8:
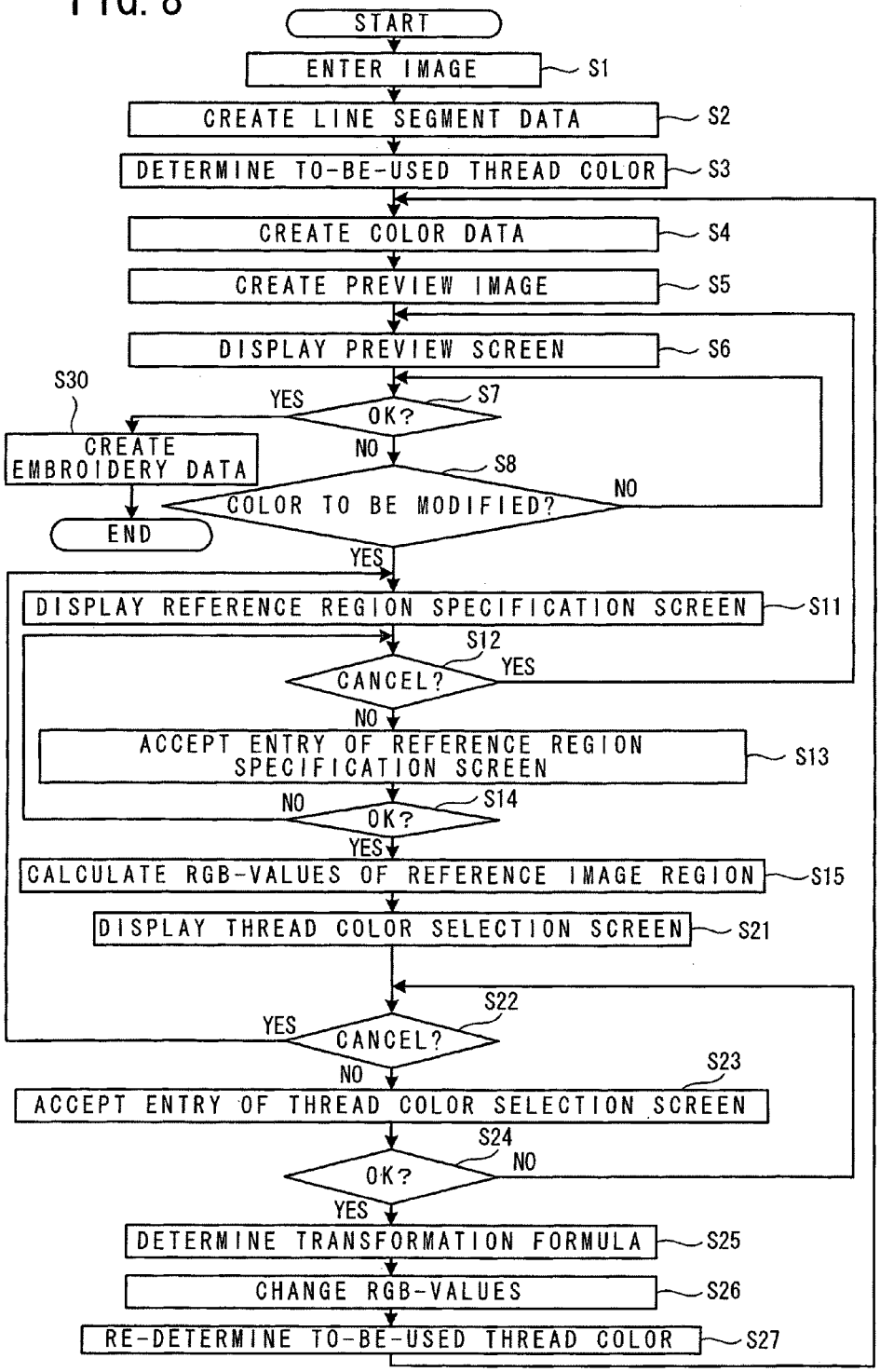
FIG. 8 is a flowchart of operations of an embroidery data creation program.

Next, as shown in FIG. 8, after the line segment data is created (S2), the process determines a color of a thread to be used in embroidery and stores it in the to-be-used thread color storage area 1024 (S3). In the present embodiment, 10 thread colors are used. The process determines the ten thread colors with higher frequencies of usage according to a known median cutting method among the thread colors stored in the thread color information storage area 122.

Next, the process creates a color data based on the image data stored in the image data storage area 121 and stores it in the color data storage area 124 (S4). First, the process sets a reflection reference height required to determine a range (reference range) in which colors contained in the image data are referenced. One example of the reference range may be a range surrounded by two parallel lines sandwiching a line segment and two perpendicular lines at the two ends of the line segment. With this, the reflection reference height is a quantity (for example, the number of the pixels or length of the result of the embroidery) that indicates a distance to one of the parallel lines from the line segment identified by the line segment information. To draw the line segment, an image having the same size as the image data is created as a transformed image in the color data relation storage area 1025 in the RAM 102. It is to be noted that the range in which the color of the image data is referenced may be set beforehand or entered by the user.

Next, the process sets a reference region when drawing in the transformed image a line segment identified by the line segment information created for a given target pixel and obtains sum Cs1 of an R-value, a G-value, and a B-value for each of the pixels contained in this reference region. Further, the number of the pixels used to calculate this sum Cs1 is assumed to be d1. However, the pixels where the line segment is not drawn (does not pass through) and the pixels where a to-be-drawn line segment passes through are not to be used in the calculation.

Further, for a reference region corresponding to the image data, the process also obtains sum Cs2 of an R-value, a G-value, and a B-value for each of the pixels contained in this reference region. The number of the pixels contained in this reference region is assumed to be d2.

Further, the process assumes the number of the pixels of the to-be-drawn line segment to be s1 and calculates a color CL based on the following formula: (Cs1+CLxs1)÷(s1+d1)=Cs2÷d2. This means that if the color CL is set to a to-be-drawn line segment, an average value of the colors of a line segment in the reference region may be equal to an average value of the colors in a reference region corresponding to an original image.

Finally, the process obtains a thread color having the smallest distance d to the color CL of the line segment in an RGB space from among the thread colors stored in the to-be-used thread color storage area 1024 and stores it as a color component of the line segment in the color data storage area 124. It is to be noted that distance d in the RGB space is calculated in accordance with the following Equation (3), assuming the calculated R-, G-, and B-values of the color CL to be r0, g0, and b0 and the RGB values of the entered thread color to be m, gn, and bn.

$$d = \sqrt{(r0 - M)^2 + (g0 - gn)^2 + (b0 - bn)^2} \quad (3)$$

Then, as shown in FIG. 8, based on the line segment data created at S2 and the color data created at S4, a preview image is created and stored in the preview image storage area 1026 (S5). The preview screen 100 (see FIG. 5) appears and the created preview image is displayed in the preview image region 105 (S6). Then, the process determines whether or not the OK button 110 is selected (S7). If the OK button 110 is selected (YES at S7), this indicates that the user has determined to accept an embroidery result displayed in the preview image region 105, so that the process creates the embroidery data based on the line segment data created at S2 and the color data created at S4 (S30) and the processing is stopped. On the other hand, if the OK button 110 is not selected (NO at S30), the process determines whether or not the color modification button 109 is selected (S8). If the color modification button 109 is not selected (NO at S8), the process returns to S7, to repeat determinations as to whether or not the OK button 110 or the color modification button 109 have been selected (S7, S8).

If the color modification button 109 is selected (YES at S8), the reference region specification screen 200 (see FIG. 6) appears (S11). Then, the process determines whether or not the cancel button 203 is selected (S12). If the cancel button 203 is not selected (NO at S12), the process accepts the entry of the reference region specification screen 200 into the preview image region 201 (S13). Specifically, in a case where the mouse pointer 204 is placed in the preview image region 201, the process displays at the tip of the mouse pointer 204 the region specification frame 205 that encloses a predetermined region. If the mouse 21 is clicked there, the process stores, in the reference image region storage area 1021, values (coordinates of the upper left pixel and the lower right pixel) that indicate the pixels of the reference image region, which is a region of the image data corresponding to a reference region enclosed by the region specification frame 205. Then, the process determines whether or not the OK button 202 is selected (S14).

If the OK button 202 is selected (YES at S14), the process calculates the R-, G-, and B-values of the reference image region stored beforehand in the reference image region storage area 1021 and stores them in the reference image region RGB-value storage area 1027 (S15). Specifically, the process assumes an average value of the R-values of all the pixels in the reference image region to be the R-value of the reference image region, an average value of the G-values of all the pixels in the reference image region to be the G-value of the reference image region, and an average value of the B-values of all the pixels in the reference image region to be the B-value of the reference image region and stores them in the reference image region RGB-value storage area 1027.

On the other hand, if the OK button 202 is not selected (NO at S14), the process returns to S12. Further, if the cancel button 203 is selected (YES at S12), the process returns to S6, and displays the preview screen 100 (see FIG. 5) (S6).

If the OK button 202 is selected (YES at S14) to calculate the RGB-values of the reference image region (S15), the thread color selection screen 300 appears (S21). Then, the process determines whether or not the cancel button 303 is selected (S22). If the cancel button 303 is not selected (NO at S22), the process accepts entry of the thread color selection region 301 on the thread color selection screen 300 (S23). Specifically, if the mouse 21 is clicked at a predetermined region, in which an illustration, part number, or color name is being displayed, in the thread color selection region 301, the process recognizes that a thread color being displayed there is specified and so highlights the thread color and stores it in the selected thread color storage area 1022. Alternatively, a thread color may be selected through the keyboard 22.

Then, the process determines whether or not the OK button 302 is selected (S24). If the OK button 302 is not selected (NO at S24), the process returns to S22. Further, if the cancel button 303 is selected (YES at S22), the process returns to S11, to display the reference region specification screen 200 (see FIG. 6) (S11).

Figure 10:
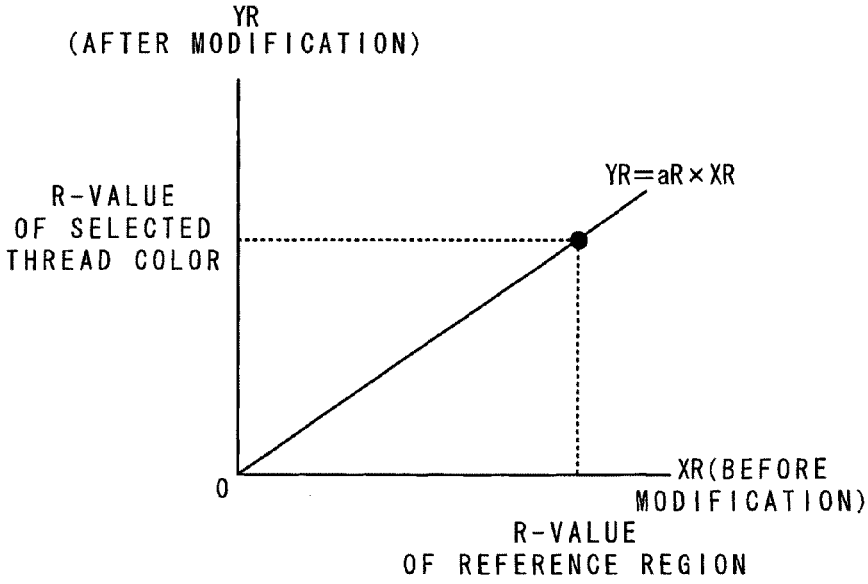
FIG. 10 is a graph of a transformation formula for R-values.

If the OK button 302 is selected (YES at S24), the process determines a transformation formula required to modify RGB-values (S25). Specifically, the process assumes that an R-value of a modification pixel to be transformed is XR (independent variable), a post-transformation R-value is YR (dependent variable), and the transformation formula is "YR=aR×XR". Similarly, it is assumed that a G-value of the modification pixel is XG (independent variable), a post-transformation G-value is YG (dependent variable), and the transformation formula is "YG=aG×XG". And, it is assumed that a B-value of the modification pixel is XB (independent variable), a post-transformation B-value is YB (dependent variable), and the transformation formula is "YB=aB×XB". It is to be noted that the constants of proportion of these transformation formulas are "aR=R-value of selected thread color/R-value of reference image region", "aG=G-value of selected thread color/G-value of reference image region", and "aB=B-value of selected thread color/B-value of reference image region." The RGB-values of the selected thread color are already read from the selected thread color storage area 1022 into the thread color information storage area 122 and the RGB-values of the reference image region are stored beforehand in the reference image region RGB-value storage area 1027. In the case of the R-value, for example, the transformation formula "YR=aR×XR" is graphically represented in FIG. 10. The slope of the line in FIG. 10 is aR.

It is assumed, for example, that the reference image region has R-value "167", G-value "106", and B-value "103", the specified thread color is "salmon pink", and salmon pink has R-value "252", G-value "187", and B-value "196". In this case, the constants of the transformation formulas are "aR=252/167=1.51", "aG=187/106=1.76", and "aB=196/103=1.90", respectively. Therefore, the transformation formulas are "YR=1.51×XR", "YG=1.76×XG", and "YB=1.90×XB", respectively. Specifically, these constants of proportion are stored in the transformation formula information storage area 1028.

Subsequently, the process substitutes the RGB-values of the pixels of the image data stored in the image data storage area 121 into the respective transformation formulas determined at S25, to calculate a post-transformation R-value (YR), a post-transformation G-value (YG), and a post-transformation B-value (YB), thus changing the RGB-values stored in the image data storage area 121 (S26). It is to be noted that the RGB-value is assumed to be "255" if it is larger than "255". In such a case, the to-be-used thread color is determined again (S27). Specifically, a thread color stored in the selected thread color storage area 1022 is stored in the to-be-used thread color storage area 1024, after which the remaining nine thread colors are determined by the known median cutting method. Then, the process returns to S4.

At S4, the process creates color data based on the image data obtained after modification of the color (RGB-values) stored in the image data storage area 121 (S4). Then, the process creates the preview image of an embroidery result due to the embroidery data created from the post-color modification image data (S5) and displays the preview image on the preview screen 100 (S6). Then, the process determines whether or not the OK button 110 is selected (S7). If the OK button 110 is selected (YES at S7), the process recognizes that the user has accepted the embroidery result displayed in the preview image region 105 and creates the embroidery data based on the line segment data created at S2 and the color data created at S4 (S30) and ends the processing. It is to be noted that the embroidery data also includes data that determines an order in which to perform sewing including moving the sewing needle 34 to account for jump stitches actually in the embroidery sewing machine 3. Further, the embroidery data can be used in the embroidery sewing machine 3 and includes a data structure required to drive the Y-directional drive mechanism and the X-directional drive mechanism.

On the other hand, if the OK button 110 is not selected (NO at S7), the process determines whether or not the color modification button 109 is selected (S8). If the color modification button 109 is not selected (NO at S8), the process returns to S7, to repeat determinations of whether or not the OK button 110 or the color modification button 109 have been selected by the user (S7, S8).

If the color modification button 109 is selected (YES at S8), the process determines that even the post-color modification image data is not acceptable and displays the reference region specification screen 200 (See FIG. 6 and FIG. 8, S11). Then, the process performs S12 and subsequent processing steps to specify a reference region again (S12-S14), calculate the RGB-values of the reference image region (S15), select a thread color (S21-S24), modify a color of the image data based on the RGB-values of the reference image region and the RGB-values of the thread color (S25, S26), determine a new to-be-used thread color (S27), and create a color data again based on the image data obtained after modification of the color (RGB-values) stored beforehand in the image data storage area 121 (S4). Then, the process again determines whether or not a user accepts an embroidery result of the embroidery data created from the post-color modification image data (S5-S8). In such a manner, the process repeats the processing of S4-S27; if the user accepts the preview image being displayed on the preview screen 100 and selects the OK button 110 (YES at S7), the process creates an embroidery data based on the line segment data created at S2 and the color data created at S4 (S30) and ends the processing.

By way of the previously described processing, a selected thread color specified by the user as a desirable color for a user-specified reference region is determined as a to-be-used thread color and the RGB-values of the pixels of the image data are modified on the basis of the RGB-values of a reference image region for the image data corresponding to the reference region and the RGB-values of the selected thread color. Based on the post-modification image data, an embroidery data is created. The user can thus observe a preview image being displayed on the preview screen 100 and determine whether or not he accepts the color shade of an embroidery result and may further specify his intention to express a certain region (reference region) by using the selected thread color. It is thus possible to obtain a desirable embroidery result created from the image data whose color has been modified on the basis of the specified reference image region and the selected thread color.

It is to be noted that of course the embroidery data creation apparatus and the embroidery data creation program in the present disclosure are not limited to the above-described embodiments but can be modified in a variety of manners without departing from the spirit of the present disclosure.

Although in the previously described embodiment, the reference regions have been specified one by one, a plurality of reference regions may be specified at a time. In this case, the transformation formula is not limited to that used in the above-described embodiment. Instead, RGB-values of all the reference regions specified and of a selected thread color corresponding to the respective reference image regions are used. The following will describe variants of a method of determining a transformation formula.

Figure 11:
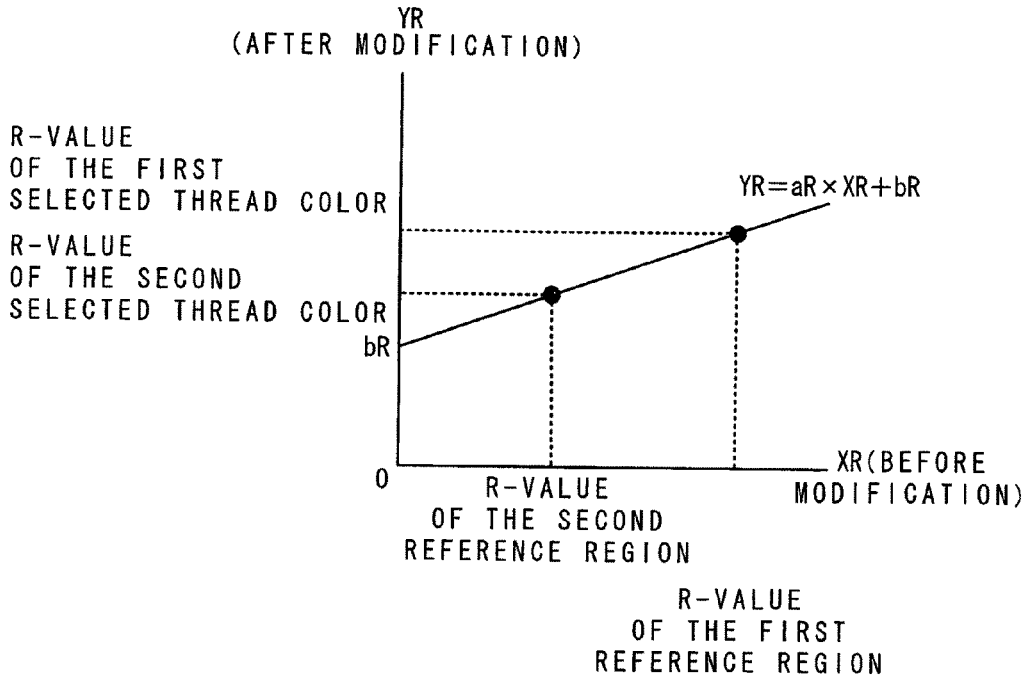
FIG. 11 is a graph of the transformation formula for R-values according to a first variant.

The first variant will be described below. The first variant applies to the case where two reference regions are specified. Therefore, assuming that a primary reference region is a first reference region, the corresponding reference image region is a first reference image region, a secondary reference region is a second reference region, the corresponding reference image region is a second reference image region, a primary selected thread color is a first selected thread color, and a secondary selected thread color is a second selected thread color, a transformation formula for R-values will be such a linear function as expressed by a graph shown in FIG. 11. The transformation formula will be "YR=aR×XR+bR"; on the assumption that "aR=(first selected thread color's R-value−second selected thread color's R-value/(first reference image region's R-value−second reference image region's R-value))", constant term bR is calculated by substituting the R-value of the first reference image region into independent variable XR in the transformation formula, the R-value of the first selected thread color into dependent variable YR, and aR into the constant of the proportion. Constants of proportion aG and aB and constant terms bG and bB are calculated in a similar manner for the G-value and the B-value, respectively.

When modifying the RGB-values, the post-modification R-value is calculated as dependent variable YR by substituting the R-value of a modification pixel into independent variable XR.

It is to be noted that the previously described embodiment can be interpreted as a special case of this first variant. That is, it is the case where only one reference region is selected, the RGB-values of a second reference image region are each set to the minimum value "0" and the RGB-values of the selected thread color are each set to the same minimum value "0".

Next, the second variant will be described below. The second variant applies to the case where one or a plurality of reference regions are specified. In the following description, the second variant will be described to the scenario where three reference regions are specified. Assuming that a primary reference region is a first reference region, the corresponding reference image region is a first reference image region, a secondary reference region is a second reference region, the corresponding reference image region is a second reference image region, a tertiary reference region is a third reference region, the corresponding reference image region is a third reference image region, a primary selected thread color is a first selected thread color, a secondary selected thread color is a second selected thread color, and a tertiary selected thread color is a third selected thread color, a transformation formula for R-values will be a linear function with dependent variable XR graphically represented in FIG. 12.

Figure 12:
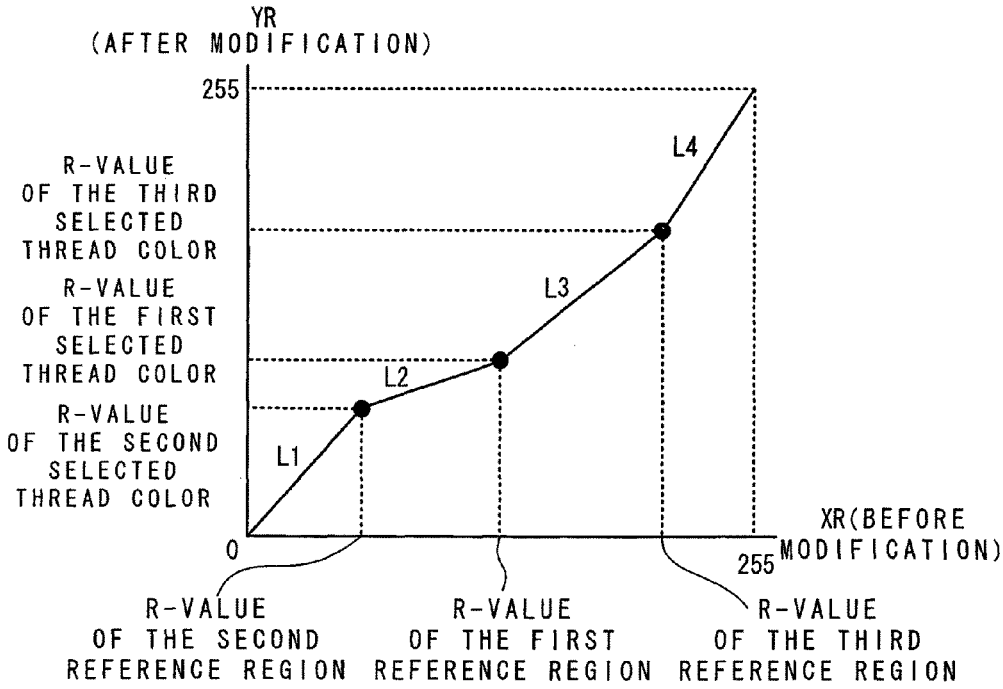
FIG. 12 is a graph of the transformation formula for R-values according to a second variant.

In this example, as shown in FIG. 12, the R-values of the reference image regions are related as following R-value of the second reference image region>R-value of the first reference image region>R-value of the third reference image region. In the second variant, different transformation formulas are used for a first domain of "0 (minimum R-value)<XR<(R-value of the second reference image region", a second domain of "R-value of the second reference image region≦XR<R-value of the first reference image region", a third domain of "R-value of the first reference image region≦XR<R-value of the third reference image region", and a fourth domain of "R-value of the third reference image region 255 (maximum R-value)". Specifically, in the first domain, a linear function "YR=a1R×XR+b1R", graphically represented as line segment L1, is used; in the second domain, a linear function "YR=a2R×XR+b1R", graphically represented as line segment L2, is used; in the third domain, a linear function "YR=a3R×XR+b1R", graphically represented as line segment L3, is used; and in the fourth domain, a linear function "YR=a4R×XR+b1R", graphically represented as line segment L4, is used.

The constants of proportion a1R, a2R, a3R, and a4R in these linear functions are respectively calculated by using one of an R-value of the reference image region at an end point of their domains, its minimum value "0", and its maximum value "255" and one of an R-value of the selected thread color, its minimum value "0", and its maximum value "255". Specifically, they are calculated respectively by "a1R=(R-value of the second selected thread color−0)/(R-value of the second reference image region−0)", "a2R=(R-value of the first selected thread color−R-value of the second selected thread color)/(R-value of the first reference image region−R-value of the second reference image region)", "a3R=(R-value of the third selected thread color−R-value of the first selected thread color)/(R-value of the third reference image region−R-value of the first reference image region)", and "a4R=(255−R-value of the third selected thread color)/(255−R-value of the third reference image region)".

Further, constant term b1R is calculated by substituting "0" into independent variable XR, "0" into dependent variable YR, and a1R into the constant of proportion in the transformation formula. Constant term b2R is calculated by substituting "R-value of the second reference image region" into independent variable XR, "R-value of the second selected thread color" into dependent variable YR, and a2R into the constant of proportion. Constant term b3R is calculated by substituting "R-value of the first reference image region" into independent variable XR, "R-value of the first selected thread color" into dependent variable YR, and a3R into the constant of proportion. Constant term b4R is calculated by substituting "255" into independent variable XR, "255" into dependent variable YR, and a4R into the constant of proportion. Constants of proportion a1G, a2G, a3G, a4G, a1B, a2B, a3B, and a4B and constant terms b1G, b2G, b3G, b4G, b1B, b2B, b3B, and b4B are calculated in a similar manner for the G-value and B-value, respectively.

Then, when modifying the RGB-values, the process determines to which domain each of the values corresponds and substitutes the value into the transformation formula that corresponds to that domain to calculate a post-modification value. For example, in order to modify particular R-value to create a modified R-value, first, from among "0", an R-value of the second reference image region, an R-value of the first reference image region, an R-value of the third reference image region, and "255", the values equal or larger than the R-value to be modified are extracted. A minimum value among these extracted values is then determined to be a large value. Similarly, from among "0", the R-value of the second reference image region, the R-value of the first reference image region, the R-value of the third reference image region, and "255", the values smaller than the R-value to be transformed are extracted, and a maximum value among these extracted values is determined to be a small value. Suppose, for example, in this case, the large value is the "R-value of the first reference image region" and the small value is the "R-value of the second reference image region". Consequently, the R-value of the modified pixel lies in the second domain given by "R-value of the second reference image region≦XR<R-value of the first reference image region." Thus, the linear function "YR=a2R×XR+b1R" graphically represented as line segment L2 in FIG. 12 will be used as a transformation formula, so that by substituting the R-value of the pixel to be modified into the independent variable XR, a post-modification R-value is calculated.

It is to be noted that although in the second variant, the boundary points of the domains have been included in the domain having larger R-values than the boundary point. That is, the domains of the independent variable XR are a first domain "0(minimum R-value)≦XR<R-value of the second reference image region", a second domain "R-value of the second reference image region≦R-value of the first reference image region", a third domain "R-value of the first reference image region≦<R-value of the third reference image region", and a fourth domain "R-value of the third reference image region≦XR<255(maximum R-value)." However, the boundary points may instead be included as part of the domain having smaller R-values. That is, the domains of the independent variable XR may be defined as follows: a first domain "0(minimum R-value)≦XR<R-value of the second reference image region", a second domain "R-value of the second reference image region<XR≦R-value of the first reference image region", a third domain "R-value of the first reference image region<XR≦R-value of the third reference image region", and a fourth domain "R-value of the third reference image region<XR≦255(maximum R-value)".

It is to be noted that if the number of the reference regions is not less than the number of thread colors used in embroidery data, a user-selected thread color is not always employed as a to-be-used thread color. If the number of the reference regions is not less than a predetermined percentage of the number of thread colors used in the embroidery data, the thread colors of up to the predetermined percentage may be selected from among specified thread colors to determine the remaining thread colors through the known median cutting method to be used for the remaining reference regions. For example, if 10 thread colors are used and at least six reference regions are specified, the selected thread colors corresponding to the previously specified six reference regions are used to determine the remaining four colors by the median cutting method. Further, rather than using the previously specified selected thread colors, a user can specify a desired selected thread color to be used.

Although the above-described embodiment has described a selected thread color as a to-be-used thread color, all of the ten thread colors may instead be determined by the median cutting method.

Figure 13:
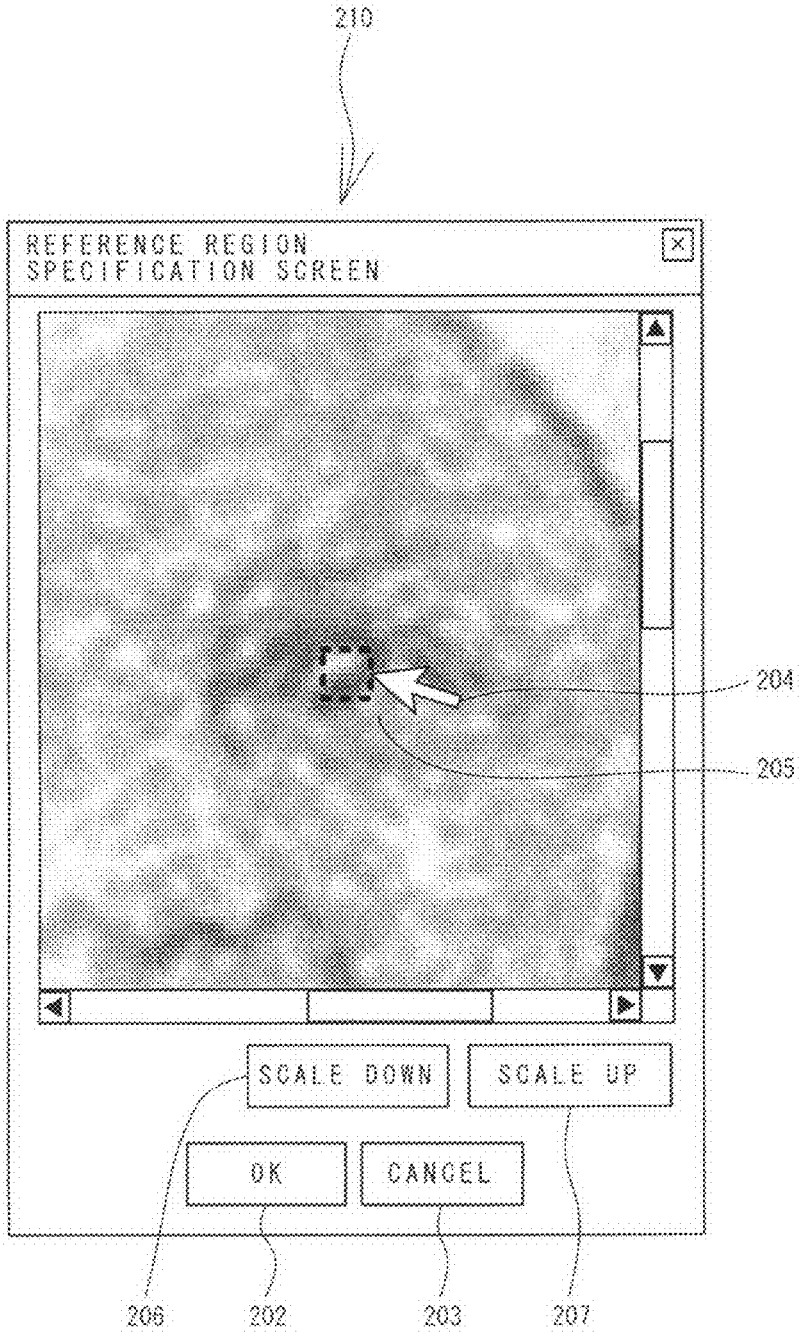
FIG. 13 is an example of the reference region specification screen of the variant.

Although the above-described embodiment has displayed a preview image (having the same size as the preview image region 105 on the preview screen 100) in the preview image region 201 on the reference region specification screen 200, a scaled up preview image may be displayed in the preview image region 201. In this case, like the reference region specification screen 210 of the variant shown in FIG. 13, a scale-up button 206 and a scale-down button 207 are provided to allow a user to scale up and scale down the preview image region 201. If the scale-up button 206 is selected, a preview image is scaled up based on a predetermined scale-up factor and displayed in the preview image region 201. On the other hand, if the scale-down button 207 is selected, a preview image is scaled down based on a predetermined scale-down factor and displayed in the preview image region 201. It is to be noted that the region specification frame 205 is also scaled up based on the same scale-up factor as that of the preview image, without changing the number of the pixels of the region enclosed by the region specification frame 205. Thus, as shown in FIG. 13, a reference region whose color is to be specified can be specified with increased precision.

Further, in the above-described embodiment, the RGB-values of all the pixels of the image data have been modified to obtain modified pixels. However, rather than modifying all the pixels, pixels (region) whose color is to be modified may be specified by the user or may be pixels of a reference image region and the surroundings of the reference image region (pixels within a predetermined distance, or a range in which the continuity of the color is kept). Further, although RGB-values have been used as color relation values, the color relation values are not limited to those and may be XYZ-values, L*a*b* values, or Munsell values.

Further, although the above-described embodiment has displayed illustrations, part numbers, and color names that indicate thread colors in the thread color selection region 301 on the thread color selection screen 300, of course, these may all be replaced with any information that enables specifying the colors.

According to the above-described embroidery data creation apparatus and a recording medium in which the embroidery data creation program is recorded, even if the color shade of a displayed preview image does not match a user's intention, a user-desired thread color to be used in sewing of a user-desired portion can be specified by way of specification of a reference region and selection of the thread color. Then, based on a relationship between the specified reference region color and the thread color, the color of the image data is modified to create the embroidery data, so that the embroidery data enables embroidering the user-desired portion by using the user-desired thread colors.

What is claimed is:

1. An embroidery data creation apparatus comprising:

a thread color relation value storage device that stores a color relation value that corresponds to a color, for each embroidery thread which is used in an embroidery data, wherein the embroidery data is created based on image data already formed with an aggregate of pixels;

a preview image creation device that creates a preview image required to confirm a result of an embroidery performed using the embroidery data created based on the image data;

a preview display device that displays the preview image created by the preview image creation device;

a reference region specification device that specifies as a color modification reference region at least one region in the preview image being displayed on the preview display device;

a thread color selection device that selects a thread color to be used for the reference region specified by the reference region specification device from among the thread colors whose color relation values are stored in the thread color relation value storage device;

an image data color modification device that modifies the color of the image data by changing the color relation value of the pixels in the image data based on the color relation value corresponding to a color of a reference image region which is a region in the image data corresponding to the reference region and the color relation values stored in the thread color relation value storage device corresponding to the thread color selected by the thread color selection device; and an embroidery data creation device that creates the embroidery data from color-modified image data obtained after modifying the color by using the image data color modification device, wherein the image data color modification device comprises:

a calculation formula determination device that determines a calculation formula that is used when changing the color relation values of the pixels in the image data, based on the color relation value of the reference image region and the color relation value of the selected thread color; and a post-modification color relation value calculation device that substitutes the color relation value of a modification pixel in the image data whose color relation values are to be changed into the calculation formula determined by the calculation formula determination device, thereby calculating a post-modification color relation value of the modification pixel.

2. The embroidery data creation apparatus according to claim 1, wherein:

if there is only one reference region, the calculation formula determination device determines as the calculation formula a linear function that has the color relation value of the modification pixel as an independent variable, the post-modification color relation value of the modification pixel as a dependent variable, the color relation value of the selected thread color divided by the color relation value of the reference image region as a slope, and 0 as a value of a constant term; and the post-modification color relation value calculation device substitutes the color relation value of the modification pixel into the calculation formula determined by the calculation formula determination device, thereby calculating the post-modification color relation value.

3. The embroidery data creation apparatus according to claim 1, wherein:

if there are 2 reference regions, the calculation formula determination device determines as the calculation formula a linear function whose slope and constant term are determined based on the color relation values of the two reference image regions and the color relation value of the selected thread color for each of the reference regions, assuming the color relation value of the modification pixel to be an independent variable and the post-modification color relation value of the modification pixel to be a dependent variable; and the post-modification color relation value calculation device substitutes the color relation value of the modification pixel into the independent variable of the calculation formula determined by the calculation formula determination device, thereby calculating the post-modification color relation value.

4. The embroidery data creation apparatus according to claim 1, wherein the calculation formula determination device comprises:

a large value extraction device that extracts as a large value either a minimum value of values larger than the color relation value of the modification pixel or a minimum value of values equal or larger than the color relation value of the modification pixel from among a minimum value of the color relation values, a maximum value of the color relation value, and the color relation value of the reference image region; and a small value extraction device that extracts as a small value either the maximum value of values equal or less than the color relation value of the modification pixel or the maximum value of values less than the color relation value of the modification pixel from among a minimum value of the color relation values, a maximum value of the color relation value, and the color relation value of the reference image region; and determines as the calculation formula a linear function which has the color relation value of the modification pixel as an independent variable and the post-modification color relation value of the modification pixel as a dependent variable and has a slope and constant term determined by using, if the large value is the maximum value of the color relation values, the large value and the maximum value of the color relation values, respectively, if the large value is the color relation value of the reference image region, the large value and the color relation value of the selected thread color corresponding to the large value, respectively, if the small value is the minimum value of the color relation values, the small value and the minimum value of the color relation value, respectively, and if the small value is the color relation value of the reference image region, the small value and the color relation value of the selected thread color corresponding to the small value, respectively, wherein the post-modification color relation value calculation device substitutes the color relation value of the modification pixel into the independent variable of the calculation formula determined by the calculation formula determination device, thereby calculating the post-modification color relation value.

5. The embroidery data creation apparatus according to claim 1, wherein:

the color relation values are an R-value, a G-value, and a B-value; and the image data color modification device modifies a color of the image data by modifying the R-value, G-value, and B-value of the modification pixel.

6. The embroidery data creation apparatus according to claim 1, wherein the image data color modification device modifies a color of the image data by modifying the color relation values of all of the pixels of the image data.

7. An embroidery data creation apparatus comprising:

a storage device that stores a color relation value that corresponds to a color, for each embroidery thread that is used in embroidery data, wherein the embroidery data is created based on image data already formed with an aggregate of pixels;

a display device; and a controller that:

creates a preview image required to confirm a result of an embroidery performed using the embroidery data created based on the image data, wherein the preview image is displayed by the display device;

specifies as a color modification reference region at least one region in the preview image being displayed by the display device;

selects a thread color to be used for the reference region specified from among the thread colors whose color relation values are stored in the storage device;

modifies a color of the image data by changing a color relation value of pixels in the image data based on a color relation value corresponding to a color of a reference image region which is a region in the image data corresponding to the reference region and color relation values stored in the storage device corresponding to the thread color to be used for the reference region;

creates the embroidery data from color-modified image data obtained after modifying the color of the image data;

determines a calculation formula that is used when changing the color relation values of the pixels in the image data. based on the color relation value of the reference image region and the color relation value of the selected thread color; and substitutes. into the calculation formula, the color relation value of a modification pixel in the image data whose color relation values are to be changed, thereby obtaining a post-modification color relation value of the modification pixel.

8. The embroidery data creation apparatus according to claim 7, wherein:

if there is only one reference region, the controller further:

determines as the calculation formula a linear function that has the color relation value of the modification pixel as an independent variable, the post-modification color relation value of the modification pixel as a dependent variable, the color relation value of the selected thread color divided by the color relation value of the reference image region as a slope, and 0 as a value of a constant term; and substitutes the color relation value of the modification pixel into the calculation formula, thereby obtaining the post-modification color relation value.

9. The embroidery data creation apparatus according to claim 7, wherein:

if there are two reference regions, the controller further:

determines as the calculation formula a linear function whose slope and constant term are determined based on the color relation values of the two reference image regions and the color relation value of the selected thread color for each of the reference regions, assuming the color relation value of the modification pixel to be an independent variable of the linear function and the post-modification color relation value of the modification pixel to be a dependent variable of the linear function; and substitutes the color relation value of the modification pixel into the independent variable of the calculation formula determined by the calculation formula determination device, thereby calculating the post-modification color relation value.

10. The embroidery data creation apparatus according to claim 7, wherein the controller further:

extracts as a large value either a minimum value of values larger than the color relation value of the modification pixel or a minimum value of values equal or larger than the color relation value of the modification pixel from among a minimum value of the color relation values, a maximum value of the color relation values, and the color relation value of the reference image region;

extracts as a small value either the maximum value of values equal to or less than the color relation value of the modification pixel or the maximum value of values less than the color relation value of the modification pixel from among a minimum value of the color relation values, a maximum value of the color relation values, and the color relation values of the reference image region;

determines as the calculation formula a linear function which has the color relation value of the modification pixel as an independent variable and the post-modification color relation value of the modification pixel as a dependent variable and that is determined by calculating the values of the linear function slope and constant term by using, if the large value is the maximum value of the color relation values, the large value and the maximum value of the color relation values respectively, if the large value is the color relation value of the reference image region, the large value and the color relation value of the selected thread color corresponding to the large value respectively, if the small value is the minimum value of the color relation values, the small value and the minimum value of the color relation value respectively, and if the small value is the color relation value of the reference image region, the small value and the color relation value of the selected thread color corresponding to the small value respectively; and substitutes the color relation value of the modification pixel into the independent variable of the calculation formula, thereby calculating the post-modification color relation value.

11. The embroidery data creation apparatus according to claim 4, wherein:

the color relation values are an R-value, a G-value, and a B-value; and the controller modifies a color of the image data by modifying the R-value, G-value, and B-value of the modification pixel.

12. The embroidery data creation apparatus according to claim 7, wherein the controller modifies the color of the image data by modifying the color relation values of all of the pixels of the image data.

13. A non-transit computer-readable medium encoding an embroidery data creation program, the embroidery data creation program comprising instructions for:

storing a color relation value that corresponds .to a color, for each embroidery thread which is used in an embroidery data, wherein the embroidery data created based on image data already formed with an aggregate of pixels;

creating a preview image for confirming a result of an embroidery performed using the embroidery data that is based on the image data;

displaying the preview image;

specifying, as a color modification reference region, at least one region in the preview image being displayed;

selecting a thread color to be used for the reference region specified from among the thread colors whose color relation values are stored;

modifying the color of the image data by changing a color relation value of the pixels in the image data based on the color relation value that corresponds to a color of a reference image region that is a region in the image data corresponding to the reference region and the stored color relation values corresponding to the selected thread color;

creating the embroidery data from color-modified image data obtained after modifying the color;

determining a calculation formula that is used when changing the color relation values of the pixels in the image data. based on the color relation value of the reference image region and the color relation value of the selected thread color; and substituting the color relation value of a modification pixel in the image data whose color relation values are to be changed into the calculation formula determined, thereby calculating a post-modification color relation value of the modification pixel.

14. The non-transit computer-readable medium encoding the embroidery data creation program according to claim 13, wherein:

if there is only one reference region, the calculation formula is a linear function that has the color relation value of the modification pixel as an independent variable, the post-modification color relation value of the modification pixel as a dependent variable, the color relation value of the selected thread color divided by the color relation value of the reference image region as a slope, and 0 as a constant term; and the embroidery data creation program further comprises instructions for:

substituting the color relation value of the modification pixel into the calculation formula in order to calculate the post-modification color relation value.

15. The non-transit computer-readable medium encoding the embroidery data creation program according to claim 13, wherein:

if there are two reference regions, the calculation formula is a linear function whose slope and constant term are determined based on the color relation values of the two reference image regions and the color relation value of the thread color selected for each of the reference regions, wherein the linear function has the color relation value of the modification pixel as the independent variable and the post-modification color relation value of the modification pixel as the dependent variable; and wherein the embroidery data creation program further comprises instructions for substituting the color relation value of the modification pixel into the independent variable of the calculation formula determined in order to calculate the post-modification color relation value.

16. The non-transit computer-readable medium encoding the embroidery data creation program according to claim 13, wherein the embroidery data creation program further comprises instructions for:

extracting as a large value either a minimum value of values greater than the color relation value of the modification pixel or a minimum value of values equal to or greater than the color relation value of the modification pixel from among a minimum value of the color relation values, a maximum value of the color relation values, and the color relation value of the reference image region;

extracting as a small value either the maximum value of values equal to or less than the color relation value of the modification pixel or the maximum value of values less than the color relation value of the modification pixel from among a minimum value of the color relation values, a maximum value of the color relation values, and the color relation value of the reference image region;

determining as the calculation formula a linear function that has the color relation value of the modification pixel as an independent variable and the post-modification color relation value of the modification pixel as a dependent variable and a slope and a constant term are determined by using, if the large value is the maximum value of the color relation values, the large value and the maximum value of the color relation values respectively, if the large value is the color relation value of the reference image region, the large value and the color relation value of the selected thread color corresponding to the large value respectively, if the small value is the minimum value of the color relation values, the small value and the minimum value of the color relation value respectively, and if the small value is the color relation value of the reference image region, the small value and the color relation value of the selected thread color corresponding to the small value respectively; and substituting the color relation value of the modification pixel into the independent variable of the calculation formula determined in order to calculate the post-modification color relation value.

17. The non-transit computer-readable medium encoding the embroidery data creation program according to claim 13, wherein:

the color relation values are an R-value, a G-value, and a B-value; and the embroidery data creation program further comprises instructions for:

modifying a color of the image data by modifying the R-value, G-value, and B-value of a modification pixel.

18. The non-transit computer-readable medium encoding the embroidery data creation program according to claim 13, wherein a color of the image data is modified by modifying the color relation values of a modification pixel, the modification pixel including all of the pixels of the image data.

* * * * *